US008203407B2

(12) United States Patent
Lin et al.

(10) Patent No.: US 8,203,407 B2
(45) Date of Patent: Jun. 19, 2012

(54) SURFACE MOUNT MAGNETIC DEVICE

(75) Inventors: Tsai-Shen Lin, Taoyuan (TW); Jui-Chu Cheng, Taoyuan (TW); Su-Chiung Hsu, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 574 days.

(21) Appl. No.: 11/764,340

(22) Filed: Jun. 18, 2007

(65) Prior Publication Data

US 2008/0231406 A1 Sep. 25, 2008

(30) Foreign Application Priority Data

Mar. 23, 2007 (TW) ..... 96110248 A

(51) Int. Cl.

| | |
|---|---|
| ***H01F 27/02*** | (2006.01) |
| ***H01F 27/29*** | (2006.01) |
| ***H01F 5/00*** | (2006.01) |
| ***H01F 27/24*** | (2006.01) |
| ***H01F 27/28*** | (2006.01) |

(52) U.S. Cl. ..... 336/83; 336/192; 336/200; 336/212; 336/232

(58) Field of Classification Search ..... 336/83, 336/192, 200, 232

See application file for complete search history.

(56) References Cited

U.S. PATENT DOCUMENTS

| | | | | |
|---|---|---|---|---|
| 6,249,202 | B1 * | 6/2001 | Yamada | 336/65 |
| 2002/0067234 | A1 * | 6/2002 | Kung | 336/192 |
| 2004/0124950 | A1 * | 7/2004 | Hsu et al. | 333/185 |
| 2005/0285707 | A1 * | 12/2005 | Furuya | 336/208 |
| 2006/0022788 | A1 * | 2/2006 | Sasamori et al. | 336/208 |
| 2006/0103262 | A1 * | 5/2006 | Sano et al. | 310/263 |
| 2006/0197644 | A1 * | 9/2006 | Lin | 336/212 |
| 2006/0279395 | A1 * | 12/2006 | Lee et al. | 336/221 |

FOREIGN PATENT DOCUMENTS

| | | | |
|---|---|---|---|
| JP | 06096956 | A * | 4/1994 |
| JP | 2003309024 | A * | 10/2003 |

* cited by examiner

*Primary Examiner* — Elvin G Enad
*Assistant Examiner* — Tsz Chan
(74) *Attorney, Agent, or Firm* — Kirton McConkie; Evan R. Witt

(57) ABSTRACT

A surface mount magnetic device includes a magnetic core assembly, a winding coil and an extension region. The magnetic core assembly includes a first magnetic part and a second magnetic part. The second magnetic part has a first surface and a second surface. The first surface of the second magnetic part is connected to second magnetic part such that a receptacle is formed between the first magnetic part and the second magnetic part. The winding coil is partially accommodated within the receptacle and includes at least two pins, wherein the pins are attached on the second surface of the second magnetic part. The extension region is integrally formed on the second surface of the second magnetic part.

19 Claims, 14 Drawing Sheets

SURFACE MOUNT MAGNETIC DEVICE

FIELD OF THE INVENTION

The present invention relates to a magnetic device, and more particularly to a surface mount magnetic device.

BACKGROUND OF THE INVENTION

Magnetic devices such as inductors and transformers are widely used in many electronic apparatuses such as power supply apparatuses or power adapters. Since the power supply apparatuses or power adapters are developed toward minimization and high power, the volumes of the magnetic devices for use in these electronic apparatuses are gradually reduced and the shapes thereof become flatter. Moreover, the magnetic devices can be directly arranged on a circuit board according to a surface mount technology (SMT). Consequently, such a magnetic device is also referred as a surface mount device (SMD).

Referring to FIG. 1(*a*), a schematic perspective view of a conventional SMD inductor mounted on a circuit board is illustrated. The SMD inductor 1 of FIG. 1(*a*) includes a magnetic core assembly 10, a winding coil 11, a first pin 12*a* and a second pin 12*b*. The pins 12*a* and 12*b* are coupled to both ends of the winding coil 11. The magnetic core assembly 10 has a receptacle 13. A magnetic pillar (not shown) is accommodated within the receptacle 13. The winding coil 11 is wound around the magnetic pillar and disposed within the receptacle 13. The first pin 12*a* and the second pin 12*b* are extended from the bottom surface of the magnetic core assembly 10. The first pin 12*a* and the second pin 12*b* are bonded onto corresponding contact portions 21*a* and 21*b* on the circuit board 2 according to a surface mount technology (SMT) so as to fix the SMD inductor 1 on the circuit board 2.

FIG. 1(*b*) is a schematic cross-sectional view of the SMD inductor shown in FIG. 1(*a*) taken from the cross-section A. As shown in FIG. 1(*b*), the SMD inductor 1 is mounted on the circuit board 2 according to a surface mount technology. The first pin 12*a* and the second pin 12*b* of the SMD inductor 1 is welded onto the contact portions 21*a* and 21*b* of the circuit board 2 by using a soldering material 22, thereby fixing the SMD inductor 1 on the circuit board 2. Since a gap 23 is formed between the SMD inductor 1 and the circuit board 2, the contact area between the SMD inductor 1 and the circuit board 2 is dependent on the pins 12*a* and 12*b*. Due to the small contact area between the SMD inductor 1 and the circuit board 2, the pins 12*a* and 12*b* fail to be firmly fixed onto the circuit board 2. Moreover, if the bottoms of the pins 12*a* and 12*b* are uneven or if the amount of the soldering material 22 is insufficient, the pins 12*a* and 12*b* also fail to be firmly fixed onto the circuit board 2 due to the poor solderability. In addition, the adhesion between the pins 12*a*, 12*b* and the contact portions 21*a* and 21*b* of the circuit board 2 may be insufficient because the pins 12*a*, 12*b* are readily shifted during the boning process. If no additional vibration-absorption structure is used to alleviate the stress when the electronic apparatus is suffered from an impact or collision, the SMD inductor 1 may be detached from the circuit board 2 in the vicinity of the pins 12*a* and 12*b*. As a consequence, the product reliability is impaired.

In views of the above-described disadvantages resulted from the prior art, the applicant keeps on carving unflaggingly to develop an improved surface mount magnetic device according to the present invention through wholehearted experience and research.

SUMMARY OF THE INVENTION

It is an object of the present invention to provide a surface mount magnetic device capable of withstanding stress, impact or collision.

Another object of the present invention provides a surface mount magnetic device firmly fixed on the circuit board.

In accordance with an aspect of the present invention, there is provided a surface mount magnetic device. The surface mount magnetic device includes a magnetic core assembly, a winding coil and an extension region. The magnetic core assembly includes a first magnetic part and a second magnetic part. The second magnetic part has a first surface and a second surface. The first surface of the second magnetic part is connected to second magnetic part such that a receptacle is formed between the first magnetic part and the second magnetic part. The winding coil is partially accommodated within the receptacle and includes at least two pins, wherein the pins are attached on the second surface of the second magnetic part. The extension region is integrally formed on the second surface of the second magnetic part.

In accordance with another aspect of the present invention, there is provided a surface mount magnetic device. The surface mount magnetic device is disposed on a circuit board, which has contact portions. The surface mount magnetic device includes a magnetic core assembly, a winding coil and an extension region. The magnetic core assembly includes a first magnetic part and a second magnetic part. The second magnetic part has a first surface and a second surface. The first surface of the second magnetic part is connected to second magnetic part such that a receptacle is formed between the first magnetic part and the second magnetic part, and the second surface of the second magnetic part faces to the circuit board. The winding coil is partially accommodated within the receptacle and includes at least two pins. The pins are attached on the second surface of the second magnetic part and bonded to corresponding contact portions of the circuit board. The extension region is integrally formed on the second surface of the second magnetic part.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a schematic cross-sectional view of the SMD inductor shown in FIG. 1(*a*) taken from the cross-section A;

FIG. 4(*b*) is a schematic side view of another surface mount magnetic device;

FIG. 4(*c*) is a schematic side view of a further surface mount magnetic device;

FIG. 5(*b*) is a schematic side view illustrating the surface mount magnetic device of FIG. 4(*b*) to be fixed on a circuit board;

FIG. 5(*c*) is a schematic side view illustrating the surface mount magnetic device of FIG. 4(*c*) to be fixed on a circuit board;

FIG. 5(*d*) is a schematic side view illustrating another surface mount magnetic device to be fixed on a circuit board;

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2:
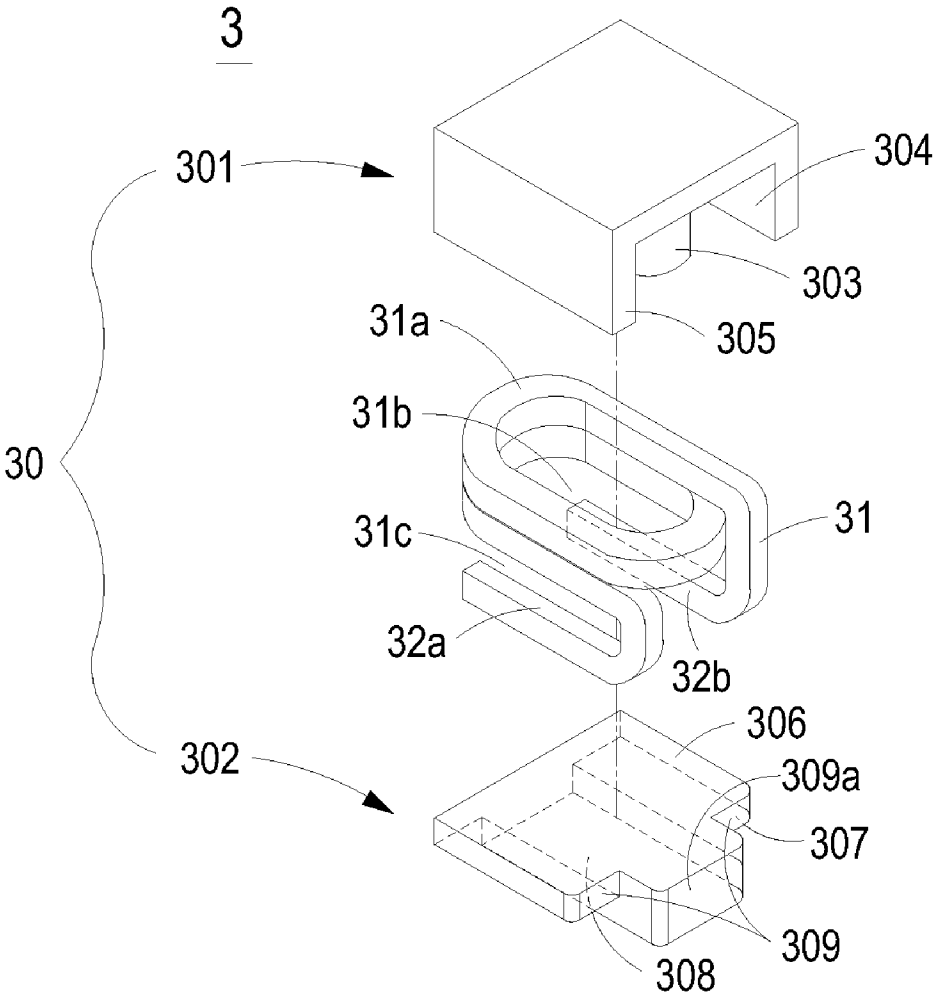
FIG. 2 is a schematic exploded view of a surface mount magnetic device according to a first preferred embodiment of the present invention.
Figure 3:
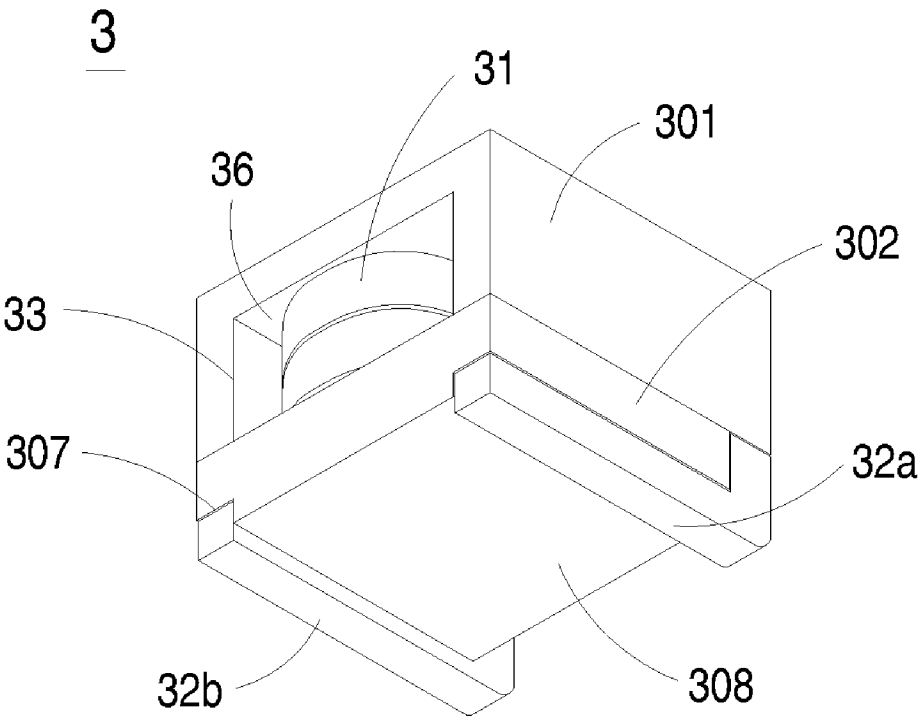
FIG. 3 is a schematic assembled view of the surface mount magnetic device shown in FIG. 2.

FIGS. 2 and 3 are respectively schematic exploded and assembled views of a surface mount magnetic device according to a preferred embodiment of the present invention. An exemplary surface mount magnetic device is a SMD inductor. As shown in FIGS. 2 and 3, the surface mount magnetic device 3 principally includes a magnetic core assembly 30, a winding coil 31, a first pin 32*a* and a second pin 32*b*. The pins 32*a* and 32*b* are integrally formed to both ends of the winding coil 31. The magnetic core assembly 30 includes a first magnetic part 301 and a second magnetic part 302. When the first magnetic part 301 and the second magnetic part 302 are combined together, a receptacle 36 is formed therebetween. Generally, the first magnetic part 301 and the second magnetic part 302 of the magnetic core assembly 30 are cooperatively shaped as an EE-type core assembly or an EI-type core assembly. In this embodiment, an EI-type core assembly is used for illustration as follows. The first magnetic part 301 includes a magnetic pillar 303, a first sidewall 304 and a second sidewall 305. The first sidewall 304 and the second sidewall 305 are disposed on opposite sides of the magnetic pillar 303. The magnetic pillar 303 may have an arbitrary shape, such as a circular shape, an elliptic shape or a rectangular shape. The second magnetic part 302 is substantially a magnetic plate and includes a first surface 306 and a second surface 307. The first surface 306 is opposed to the second surface 307. The first surface 306 is substantially flat. An extension region 308 is formed on the second surface 307. For example, the extension region 308 is a rectangular solid. It is preferred that the extension region 308 is integrally formed on the second magnetic part 302.

In some embodiments, the cross-section of the winding coil 31 is rectangle-shaped. Both ends of the winding coil 31 are formed as the first pin 32*a* and the second pin 32*b*. The winding coil 31 is received within the receptacle 36 of the magnetic core assembly 30. The middle portion 31*a* of the winding coil 31 between the first pin 32*a* and the second pin 32*b* is wound at an arbitrary winding pattern such as a circular pattern, an elliptic pattern or a rectangular pattern, provided that a channel 31*b* is defined by the middle portion 31*a* of the winding coil 31 and the first pin 32*a* and the second pin 32*b* are substantially at a same plane. Meanwhile, two vacant portions 31*c* are formed between the pins 32*a*, 32*b* and the middle portion 31*a* of the winding coil 31. After the magnetic pillar 303 of the first magnetic part 301 is embedded within the channel 31*b*, the middle portion 31*a* of the winding coil 31 is confined between the first sidewall 304 and the second sidewall 305 of the first magnetic part 301. Subsequently, the bilateral edges of the second magnetic part 302 are embedded into the vacant portions 31*c* such that the first sidewall 304 and the second sidewall 305 are in contact with the first surface 306 of the second magnetic part 302. Under this circumstance, the second magnetic part 302 and the first magnetic part 301 are combined together to form the surface mount magnetic device 3.

Please refer to FIGS. 2 and 3 again. The second magnetic part 302 further includes a side surface 309*a* coupling with the first surface 306 and the second surface 307. Optionally, one or both edges of the side surface 309*a* of the second magnetic part 302 include recess structures 309. When the second magnetic part 302 and the first magnetic part 301 are combined together, two opposite openings 33 which are communicated with the receptacle 30636 are also defined. The first pin 32*a* and the second pin 32*b* are penetrated through one of the openings 33 and then bent to be substantially parallel to the second surface 307 of the second magnetic part 302. As a consequence, the first pin 32*a* and the second pin 32*b* are received in the recess structures 309 at the second surface 307 of the second magnetic part 302. Meanwhile, the extension region 308 is arranged between the first pin 32*a* and the second pin 32*b*.

Figure 4B:
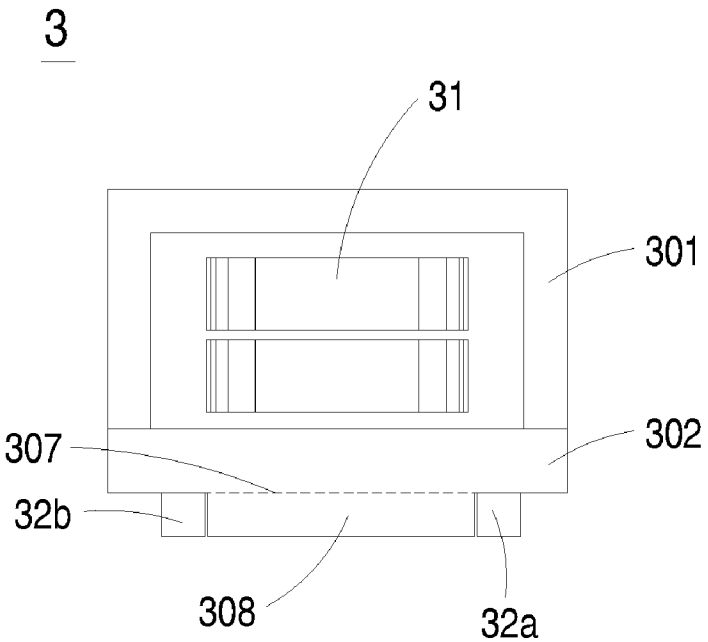
FIG. 4(*a*) is a schematic side view of the surface mount magnetic device shown in FIG. 3.
Figure 4A:
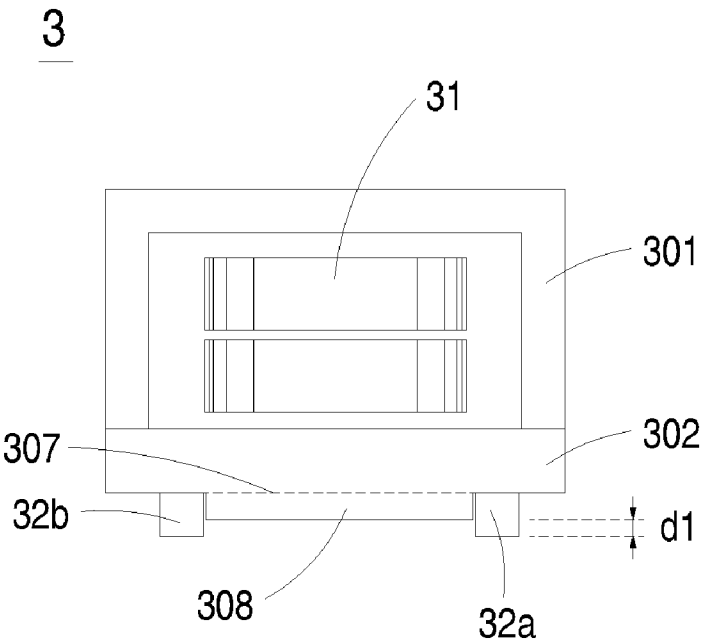
Figure 4C:
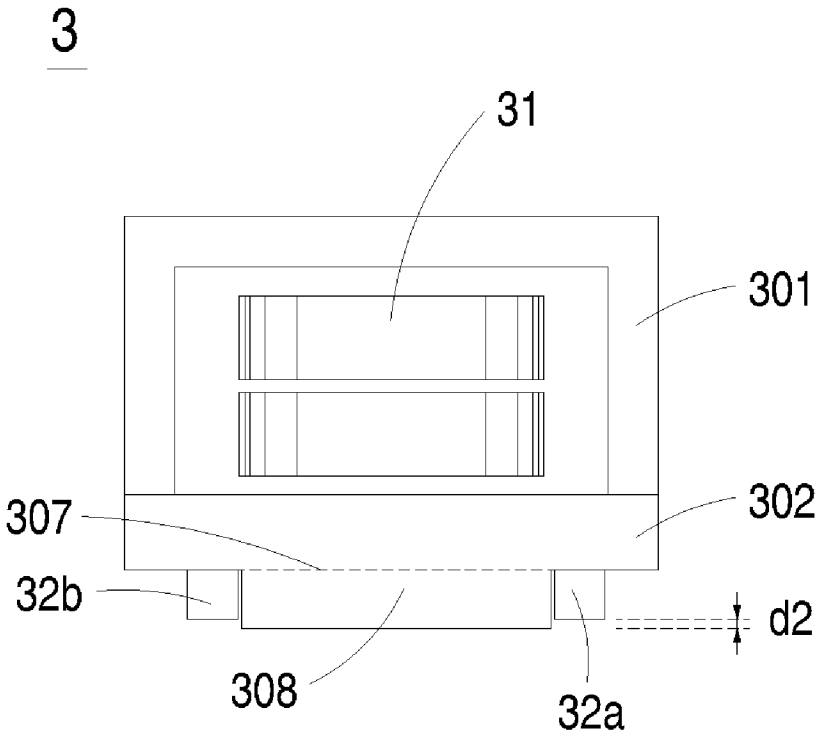
Figure 5A:
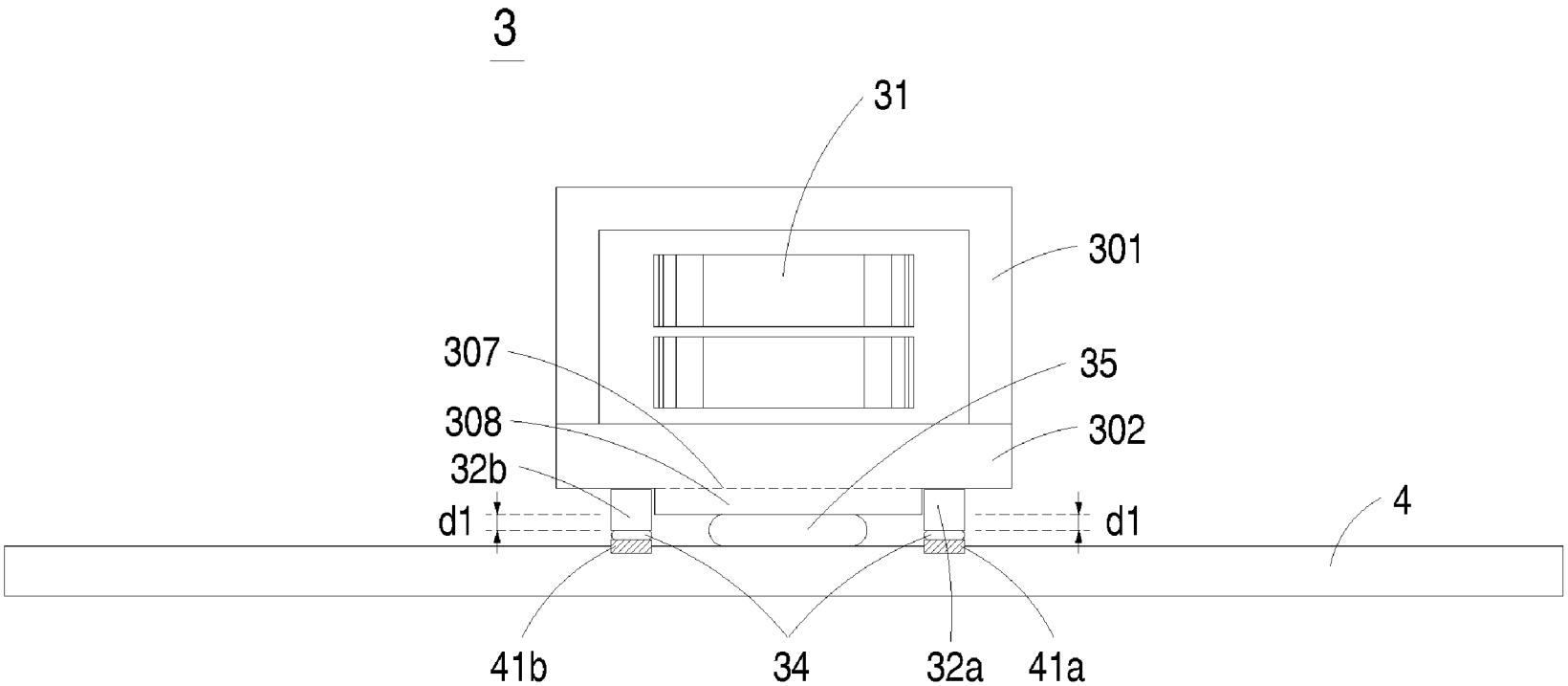
FIG. 5(*a*) is a schematic side view illustrating the surface mount magnetic device of FIG. 4(*a*) to be fixed on a circuit board.
Figure 5B:
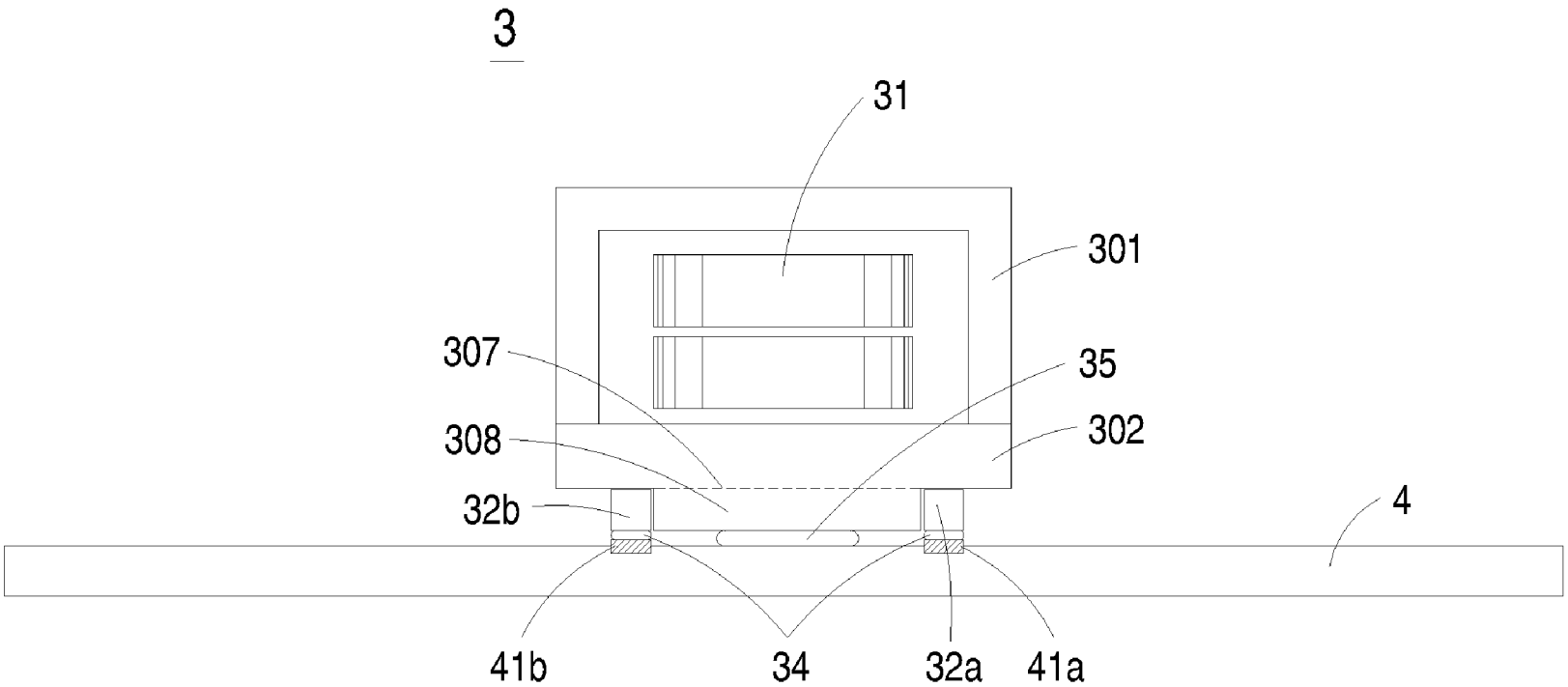
Figure 5C:
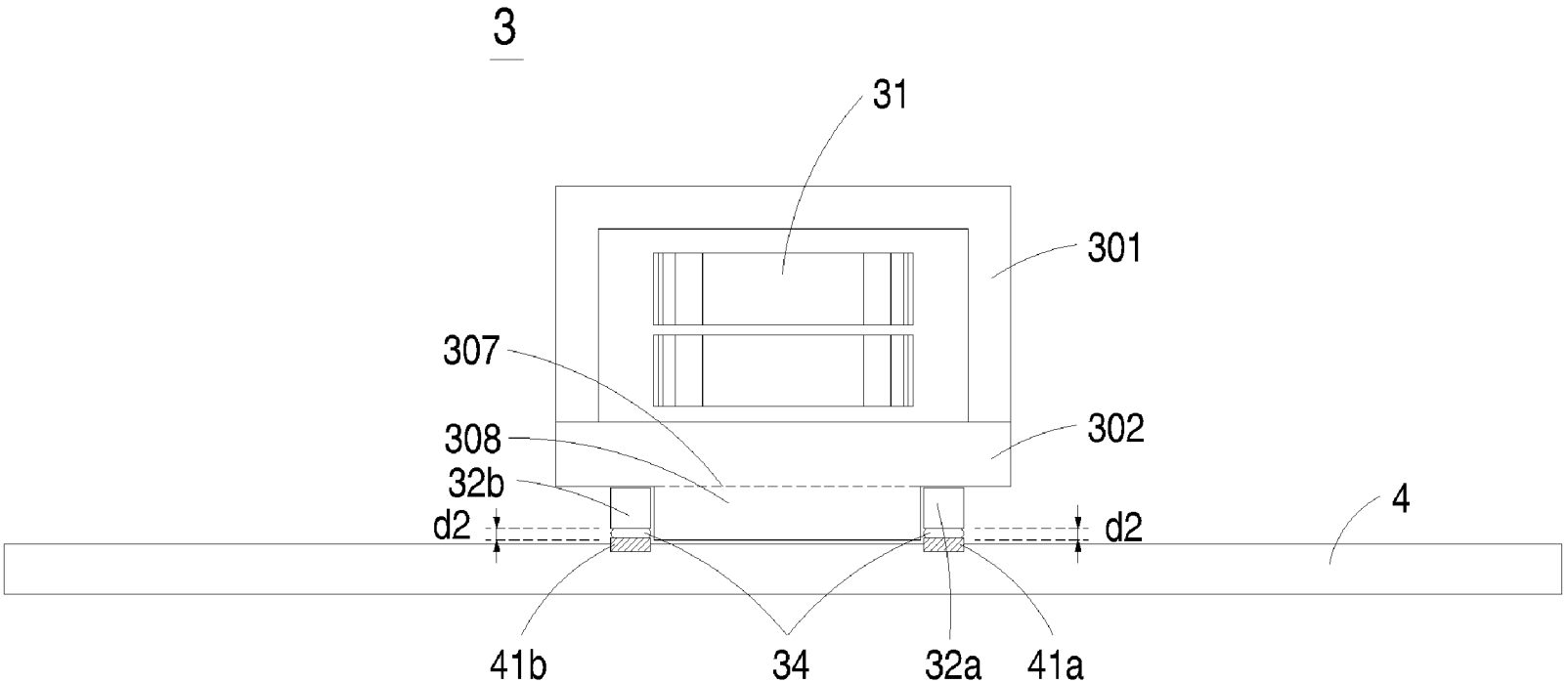
Figure 5D:
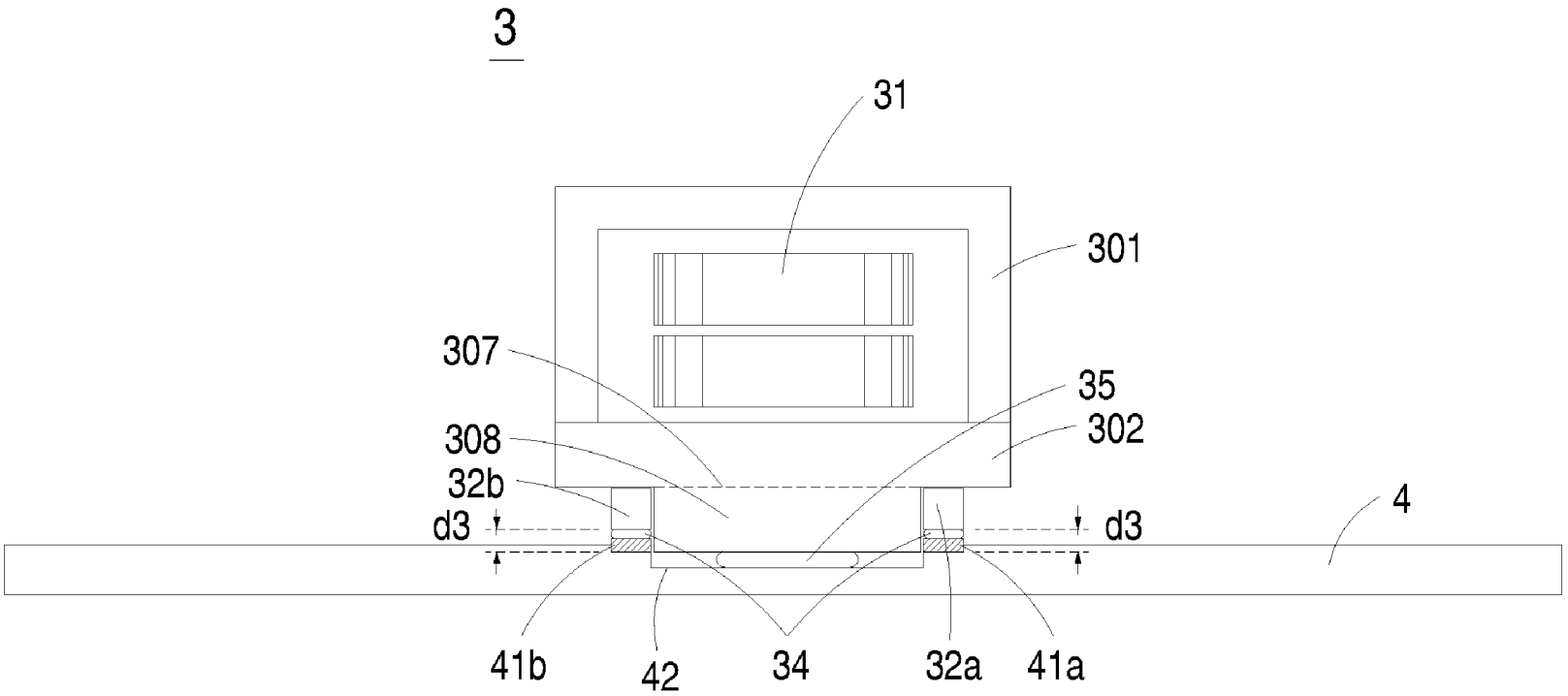

FIG. 4(*a*) is a schematic side view of the surface mount magnetic device 3 shown in FIG. 3. With respect to the second surface 307 of the second magnetic part 302, the pin 32*a* (or 32*b*) is higher than the extension region 308 by a height difference d1. It is noted that, however, those skilled in the art will readily observe that numerous modifications and alterations may be made while retaining the teachings of the invention. For example, as shown in FIG. 4(*b*), the extension region 308 and the pins 32*a*, 32*b* have the same height with respect to the second surface 307. Alternatively, as shown in FIG. 4(*c*), the extension region 308 is higher than the pin 32*a* (or 32*b*) by a height difference d2 with respect to the second surface 307.

Figure 1A:
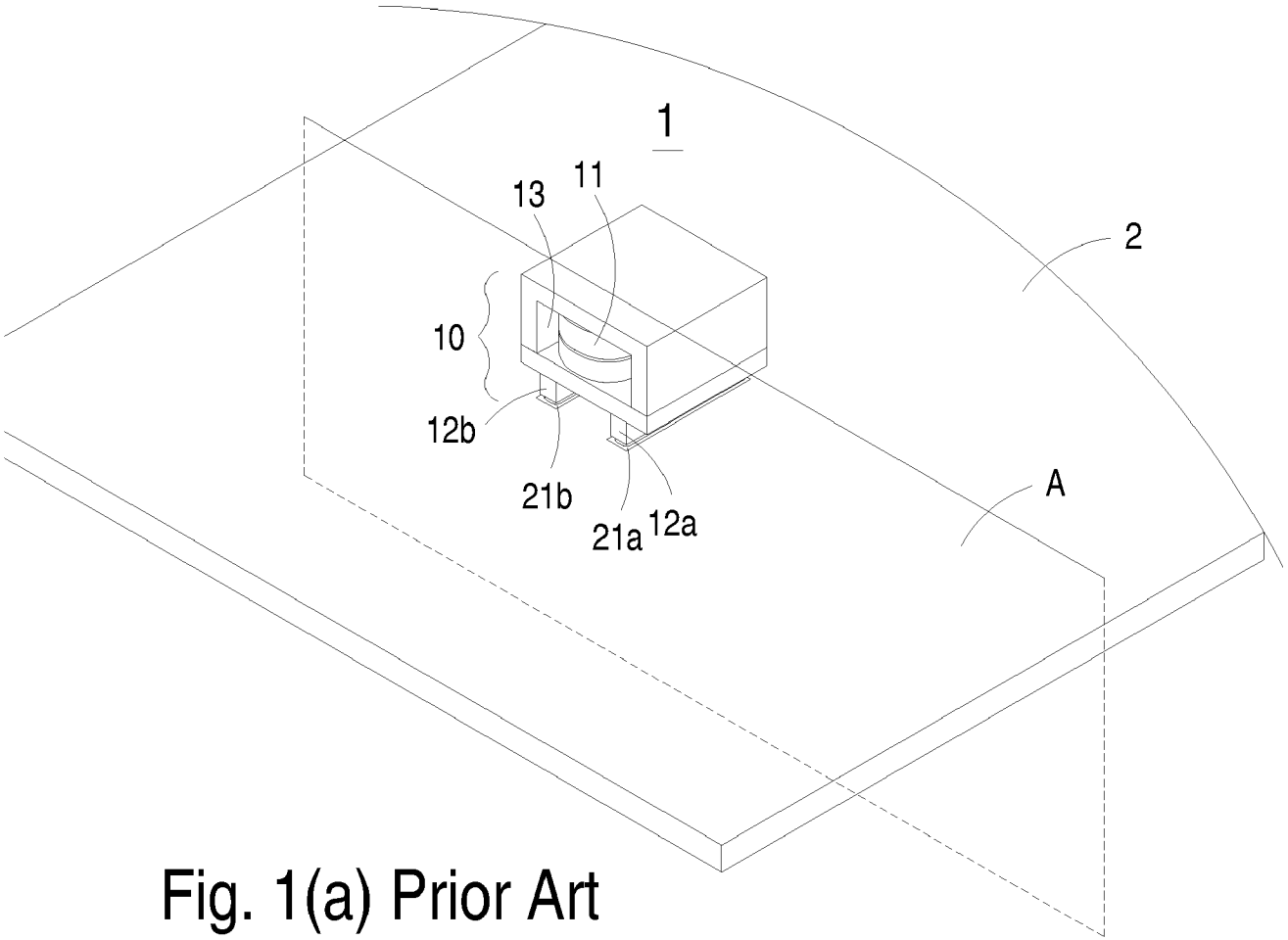
Fig. 1(a) Prior Art
FIG. 1(*a*) is a schematic perspective view of a conventional SMD inductor mounted on a circuit board.
Figure 1B:
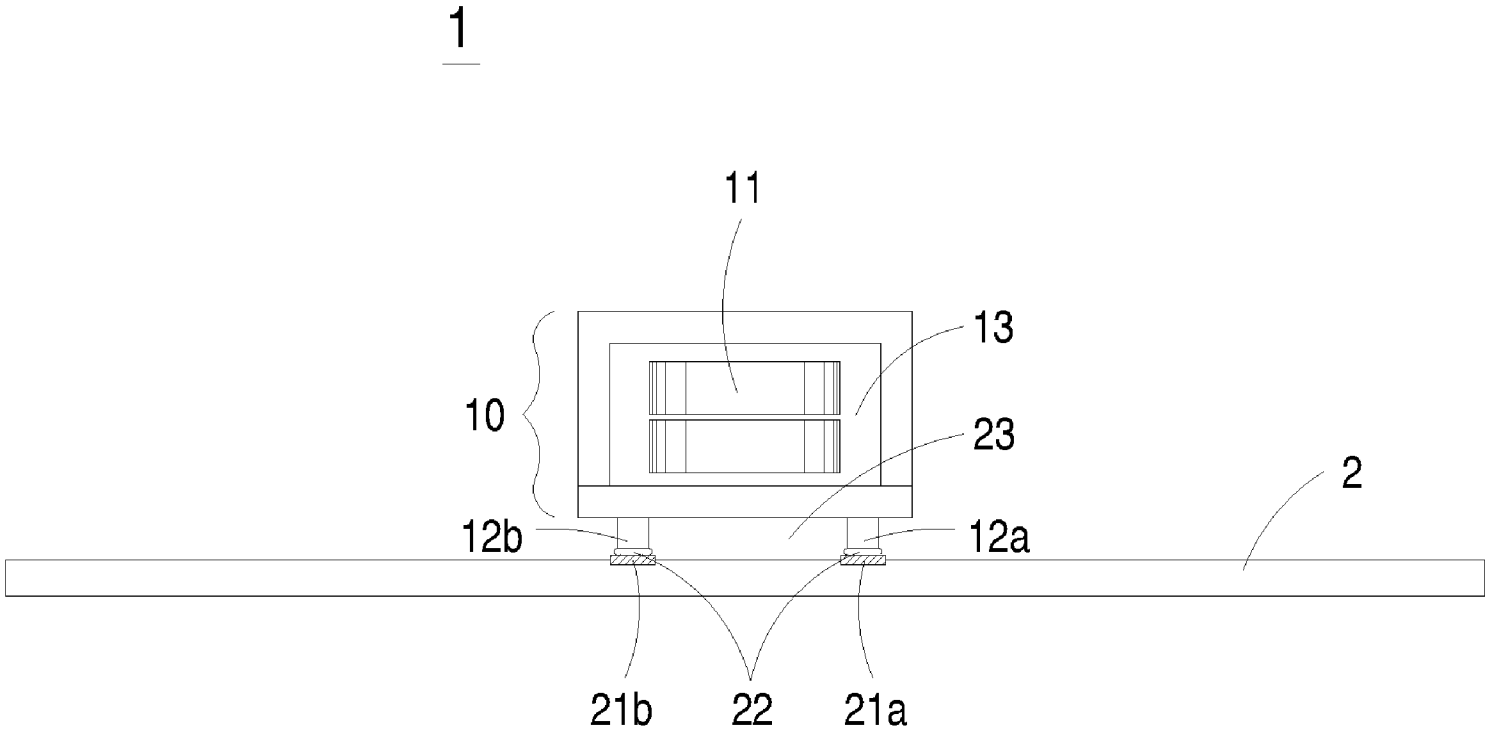
Fig. 1(b) Prior Art

FIG. 5(*a*) is a schematic side view illustrating the surface mount magnetic device 3 of FIG. 4(*a*) to be fixed on a circuit board 4. Since the pin 32*a* (or 32*b*) is higher than the extension region 308 by a height difference d1 with respect to the second surface 307, the extension region 308 is bonded onto the circuit board 4 via an adhesive 35. Moreover, by using a soldering material 34, the first pin 32*a* and the second pin 32*b* are bonded onto corresponding contact portions 41*a* and 41*b* on the circuit board 4 according to a surface mount technology (SMT) so as to fix the SMD inductor 3 on the circuit board 4. In comparison with the SMD inductor 1 as shown in FIG. 1, since the gap between the extension region 308 and the circuit board 4 is shrunk, the adhesive 35 filled into the gap may facilitate firmly fixing the SMD inductor 3 on the circuit board 4. Meanwhile, the SMD inductor 3 may lie flat on the circuit board 4. In addition, since the contact area between the SMD inductor 3 and the circuit board 4 is increased, the adhesion between the SMD inductor 3 and the circuit board 4 is also enhanced. That is, in the assistance of the extension region 308 and the adhesive 35, the capability of withstanding stress, impact or collision is enhanced.

FIG. 5(*b*) is a schematic side view illustrating the surface mount magnetic device 3 of FIG. 4(*b*) to be fixed on a circuit board 4. Since the extension region 308 and the pins 32*a*, 32*b* have the same height with respect to the second surface 307, the extension region 308 is bonded onto the circuit board 4 via an adhesive 35. Moreover, by using a soldering material 34, the first pin 32*a* and the second pin 32*b* are bonded onto corresponding contact portions 41*a* and 41*b* on the circuit board 4 according to a surface mount technology (SMT) so as to fix the SMD inductor 3 on the circuit board 4. In comparison with the SMD inductor 1 as shown in FIG. 1, since the gap between the extension region 308 and the circuit board 4 is shrunk, the adhesive 35 filled into the gap may facilitate firmly fixing the SMD inductor 3 on the circuit board 4. Meanwhile, the SMD inductor 3 may lie flat on the circuit board 4. In addition, since the contact area between the SMD inductor 3 and the circuit board 4 is increased, the adhesion between the SMD inductor 3 and the circuit board 4 is also enhanced. That is, in the assistance of the extension region 308 and the adhesive 35, the capability of withstanding stress, impact or collision is enhanced.

FIG. 5(*c*) is a schematic side view illustrating the surface mount magnetic device 3 of FIG. 4(*c*) to be fixed on a circuit board 4. Since the extension region 308 is higher than the pin 32*a* (or 32*b*) by a height difference d2 with respect to the second surface 307, the extension region 308 is in contact with the circuit board 4 and the first pin 32*a* and the second pin 32*b* are bonded onto corresponding contact portions 41*a* and 41*b* on the circuit board 4 according to a surface mount technology (SMT) by using a soldering material 34, thereby fixing the SMD inductor 3 on the circuit board 4. Since the extension region 308 of the SMD inductor 3 is in contact with the circuit board 4, the SMD inductor 3 may lie flat on the circuit board 4 and facilitate positioning the pins 32*a* and 332*b* on the circuit board 4. That is, in the assistance of the extension region 308, the capability of withstanding stress, impact or collision is enhanced.

A further embodiment of the surface mount magnetic device 3 to be fixed on a circuit board 4 is illustrated in FIG. 5(*d*). With respect to the second surface 307, the extension region 308 is higher than the pin 32*a* (or 32*b*) by a height difference d3. The value d3 is greater than the height difference d2 as shown in FIG. 5(*c*). In this embodiment, the circuit board 4 has a concave portion 42 corresponding to the extension region 308 of the SMD inductor 3. For fixing the SMD inductor 3 on the circuit board 4, the first pin 32*a* and the second pin 32*b* are bonded onto corresponding contact portions 41*a* and 41*b* on the circuit board 4 according to a surface mount technology (SMT) by using a soldering material 34 and the extension region 308 is bonded to the concave portion 42 of the circuit board 4 via an adhesive 35. In comparison with the SMD inductor 1 as shown in FIG. 1, since the gap between the extension region 308 and the circuit board 4 is shrunk, the adhesive 35 filled into the gap may facilitate firmly fixing the SMD inductor 3 on the circuit board 4. In addition, since the contact area between the SMD inductor 3 and the circuit board 4 is increased, the adhesion between the SMD inductor 3 and the circuit board 4 is also enhanced. That is, in the assistance of the extension region 308 and the adhesive 35, the capability of withstanding stress, impact or collision is enhanced.

It is noted that, however, those skilled in the art will readily observe that numerous modifications and alterations of the extension region 308 and the pins 32*a*, 32*b* may be made while retaining the teachings of the invention.

Figure 6:
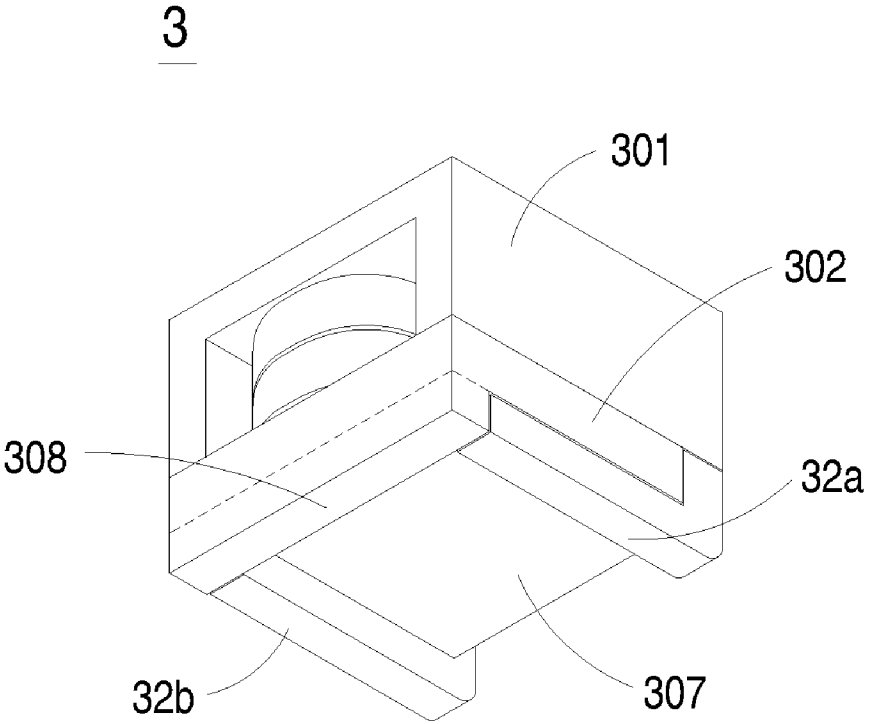
FIG. 6 is a schematic assembled view of a surface mount magnetic device according to another preferred embodiment.

For example, as shown in FIG. 6, the extension region 308 is formed on an edge of the second surface 307 and perpendicular to the pins 32*a*, 32*b*. Likewise, the extension region 308 is higher than, equal to or lower than the pin 32*a* (or 32*b*) with respect to the second surface 307. The mechanisms of mounting the SMD inductor 3 on the circuit board 4 are identical to those described above, and are not redundantly described herein.

Figure 7:
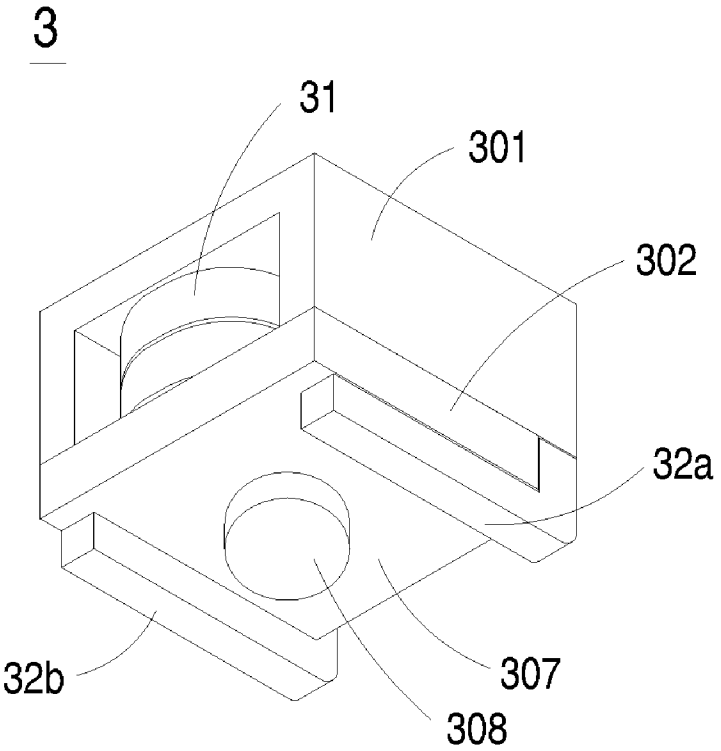
FIG. 7 is a schematic assembled view of a surface mount magnetic device according to a further preferred embodiment.

Alternatively, as shown in FIG. 7, the extension region 308 is a cylindrical solid in replace of the rectangular solid, and the extension region 308 is arranged between the first pin 32*a* and the second pin 32*b*. Likewise, the extension region 308 is higher than, equal to or lower than the pin 32*a* (or 32*b*) with respect to the second surface 307. The mechanisms of mounting the SMD inductor 3 on the circuit board 4 are identical to those described above, and are not redundantly described herein.

Figure 8:
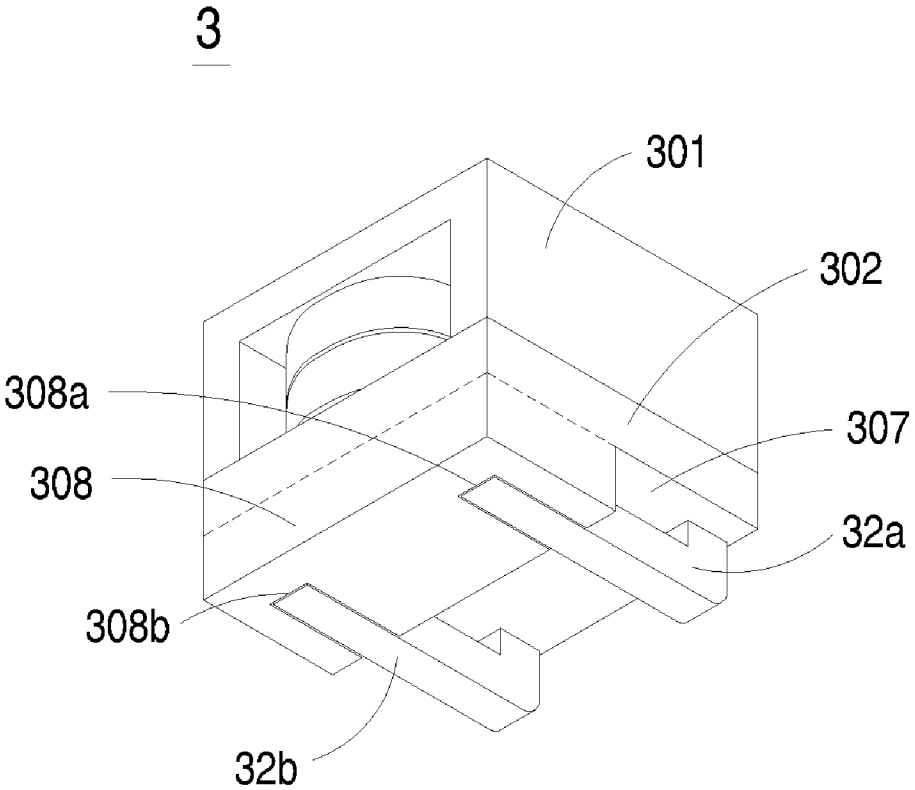
FIG. 8 is a schematic assembled view of a surface mount magnetic device according to a further preferred embodiment.

Alternatively, as shown in FIG. 8, the extension region 308 is an E-shaped solid including a first indentation 308*a* and a second indentation 308*b*. The first pin 32*a* and the second pin 32*b* are received in the first indentation 308*a* and the second indentation 308*b*, respectively. Likewise, the extension region 308 is higher than, equal to or lower than the pin 32*a* (or 32*b*) with respect to the second surface 307. The mechanisms of mounting the SMD inductor 3 on the circuit board 4 are identical to those described above, and are not redundantly described herein.

Figure 9:
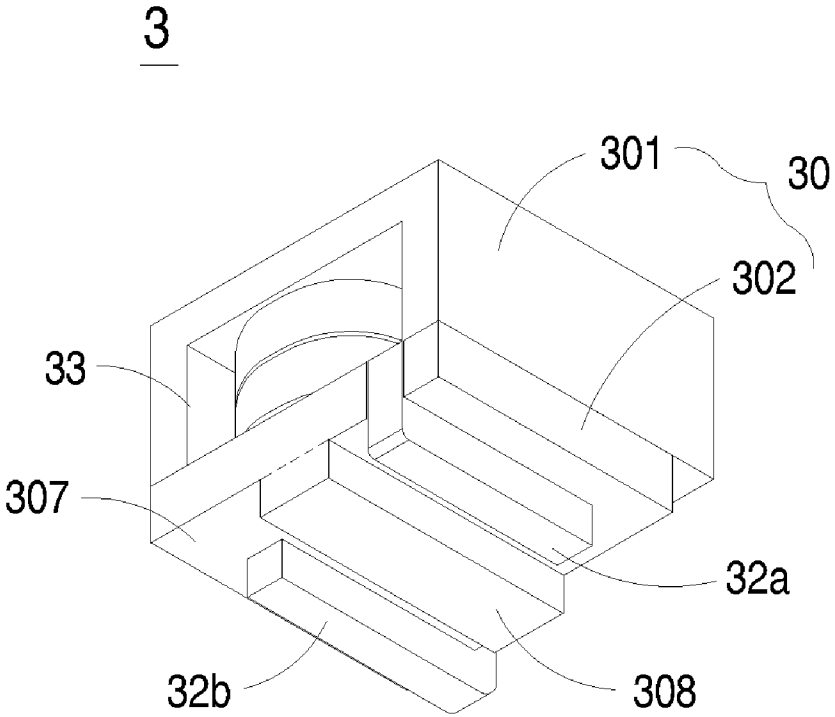
FIG. 9 is a schematic assembled view of a surface mount magnetic device according to a further preferred embodiment.

A further embodiment of a SMD inductor is schematically shown in FIG. 9. The first pin 32*a* and the second pin 32*b* are respectively penetrated through two opposite openings 33 and then bent to be substantially parallel to the second surface 307 of the second magnetic part 302. The other structures of the SMD inductor 3 are identical to those described above, and are not redundantly described herein.

From the above description, since the gap between the extension region and the circuit board is shrunk, the adhesive filled into the gap may facilitate firmly fixing the surface mount magnetic device on the circuit board. In addition, since the contact area between the surface mount magnetic device and the circuit board is increased, the adhesion between the surface mount magnetic device and the circuit board is also enhanced. That is, in the assistance of the extension region and the adhesive, the capability of withstanding stress, impact or collision is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A surface mount magnetic device comprising:

a magnetic core assembly including a first magnetic part and a second magnetic part, said second magnetic part having a first surface, a second surface and a side surface coupling with said first surface and said second surface, wherein said first surface of said second magnetic part is connected to said first magnetic part such that a receptacle is formed between said first magnetic part and said second magnetic part, and there are two recess structures formed at both edges of said side surface of said second magnetic part, respectively;

a winding coil partially accommodated within said receptacle and including at least two pins, wherein said pins are integrally formed with said winding coil and said pins are received in said recess structures at said side surface without protruding out of said side surface of said second magnetic part and attached on said second surface of said second magnetic part; and an extension region integrally formed on said second surface of said second magnetic part.

2. The surface mount magnetic device according to claim 1 wherein said surface mount magnetic device is a SMD (surface mount device) inductor.

3. The surface mount magnetic device according to claim 1 wherein said first magnetic part further includes a magnetic pillar and at least two sidewalls, said magnetic pillar being arranged between said sidewalls.

4. The surface mount magnetic device according to claim 3 wherein said magnetic pillar has a circular shape, an elliptic shape or a rectangular shape.

5. The surface mount magnetic device according to claim 3 wherein said winding coil has a middle portion between said pins, and said middle portion is wound at a circular pattern or an elliptic pattern such that said pins are substantially at a same plane.

6. The surface mount magnetic device according to claim 5 wherein said middle portion of said winding coil is wound to define a channel therebetween, and said magnetic pillar of said first magnetic part is embedded within said channel such that said winding coil is partially accommodated within said receptacle.

7. The surface mount magnetic device according to claim 5 wherein two vacant portions are formed between said at least two pins and said middle portion of said winding coil, and said second magnetic part is embedded into said vacant portions.

8. The surface mount magnetic device according to claim 1 wherein the cross-section of said winding coil is rectangle-shape.

9. The surface mount magnetic device according to claim 1 wherein said second magnetic part is substantially a magnetic plate.

10. The surface mount magnetic device according to claim 1 wherein said extension region is a rectangular solid, which is parallel or perpendicular to said pins.

11. The surface mount magnetic device according to claim 1 wherein said extension region is a cylindrical solid.

12. The surface mount magnetic device according to claim 1 wherein one or both edges of said extension region include indentations, and said pins are received in said indentations of said extension region.

13. The surface mount magnetic device according to claim 1 wherein each of said pins is higher than said extension region with respect to said second surface of said second magnetic part.

14. The surface mount magnetic device according to claim 1 wherein said extension region and said pins have the same height with respect to said second surface of said second magnetic part.

15. The surface mount magnetic device according to claim 1 wherein said extension region is higher than each of said pins with respect to said second surface of said second magnetic part.

16. A surface mount magnetic device disposed on a circuit board, said circuit board having contact portions, said surface mount magnetic device comprising:

a magnetic core assembly including a first magnetic part and a second magnetic part, said second magnetic part having a first surface, a second surface and a side surface coupling with said first surface and said second surface, wherein said first surface of said second magnetic part is connected to said first magnetic part such that a receptacle is formed between said first magnetic part and said second magnetic part, said second surface of said second magnetic part faces to said circuit board, and there are two recess structures formed at both edges of said side surface of said second magnetic part, respectively;

a winding coil partially accommodated within said receptacle and including at least two pins, wherein said pins are integrally formed with said winding coil and said pins are received in said recess structures at said side surface without protruding out of said side surface of said second magnetic part and attached on said second surface of said second magnetic part and bonded to corresponding contact portions of said circuit board; and an extension region integrally formed on said second surface of said second magnetic part.

17. The surface mount magnetic device according to claim 16 wherein an adhesive is filled in the space between said extension region and said circuit board.

18. The surface mount magnetic device according to claim 16 wherein said pins are bonded to corresponding contact portions of said circuit board via soldering material.

19. The surface mount magnetic device according to claim 16 wherein said circuit board further includes a concave portion corresponding to said extension region, and an adhesive is filled in the space between said extension region and said concave portion of said circuit board.

* * * * *